US005240099A

United States Patent [19]

Brown et al.

[11] Patent Number: 5,240,099

[45] Date of Patent: Aug. 31, 1993

[54] COIN RECEIVING AND VALIDATION APPARATUS

[75] Inventors: Terry Brown; Edward L. Teichleman, both of Capalaba, Australia

[73] Assignee: TST International Pty. Ltd., Cabalaba, Australia

[21] Appl. No.: 680,741

[22] Filed: Apr. 5, 1991

[30] Foreign Application Priority Data

Apr. 5, 1990 [AU] Australia ..... PJ9498

[51] Int. Cl.[5] ..... G07D 5/08

[52] U.S. Cl. ..... 194/317; 453/57; 453/34; 194/334

[58] Field of Search ..... 453/32-35, 453/57; 194/317, 318, 334; 221/182

[56] References Cited

U.S. PATENT DOCUMENTS

| | | | |
|---|---|---|---|
| 1,819,701 | 8/1931 | Downey | 453/34 X |
| 2,642,882 | 6/1953 | Buchholz | 453/34 X |
| 2,835,260 | 5/1958 | Buchholz | 453/34 X |
| 3,371,761 | 3/1968 | Hirano | 194/334 X |
| 3,682,286 | 8/1972 | Prumm . | |
| 3,698,537 | 10/1972 | Black et al. | 453/57 |
| 3,783,885 | 1/1974 | Williams et al. | 453/33 |
| 3,902,511 | 9/1975 | Jacobs | 453/34 X |
| 4,234,071 | 11/1980 | Le-Hong . | |
| 4,342,384 | 8/1982 | Fukase et al. | 453/56 X |
| 4,407,312 | 10/1983 | Davila et al. | 453/33 X |
| 4,436,103 | 3/1984 | Dick | 453/4 |
| 4,548,220 | 10/1985 | Le Hong et al. . | |
| 4,717,006 | 1/1988 | Chapman et al. . | |
| 5,030,165 | 7/1991 | Nilsson et al. | 194/334 X |
| 5,046,989 | 9/1991 | Dass | 453/33 X |

FOREIGN PATENT DOCUMENTS

| | | | |
|---|---|---|---|
| 3541869 | 6/1987 | Fed. Rep. of Germany | 453/57 |
| 54-20795 | 2/1979 | Japan | 453/57 |
| 2173027 | 10/1986 | United Kingdom | 453/57 |

OTHER PUBLICATIONS

IBM Technical Disclosure Bulletin, "Coin Recognition Device", vol. 31, No. 11, Apr. 1989.

*Primary Examiner*—Michael S. Huppert
*Assistant Examiner*—William M. Hienz
*Attorney, Agent, or Firm*—Buchanan Ingersoll; George Raynovich, Jr.

[57] ABSTRACT

Apparatus for use primarily in toll road systems for receiving and validating coins including a coin acceptor which comprises a rotating disc provided with recesses in its periphery for receiving coins and a coin validator adjacent the path of movement of the coins for sensing coin validity. A coin ejection mechanism is provided to reject coins if invalid as sensed by the coin validator. The apparatus also includes a compartmented coin receiving assembly for receiving coins from the acceptor and transferring them to a vault chamber.

9 Claims, 4 Drawing Sheets

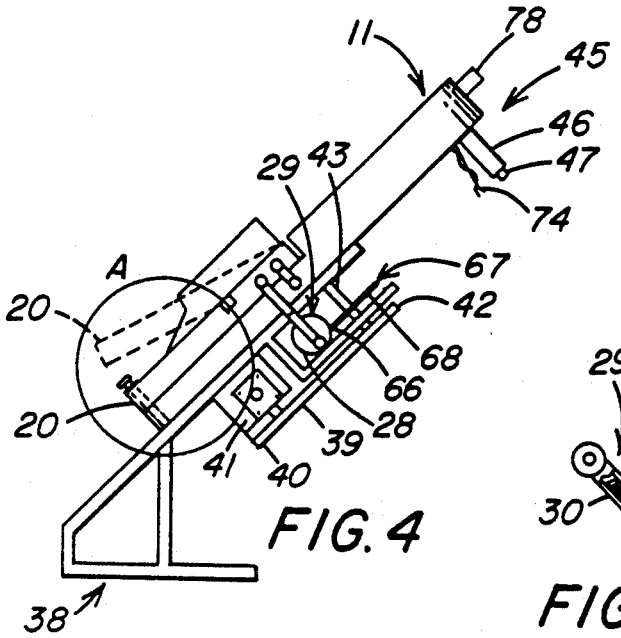
FIG. 4
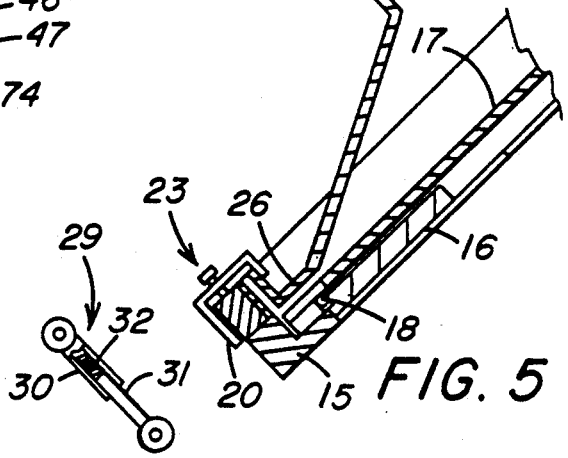
FIG. 5
FIG. 4A
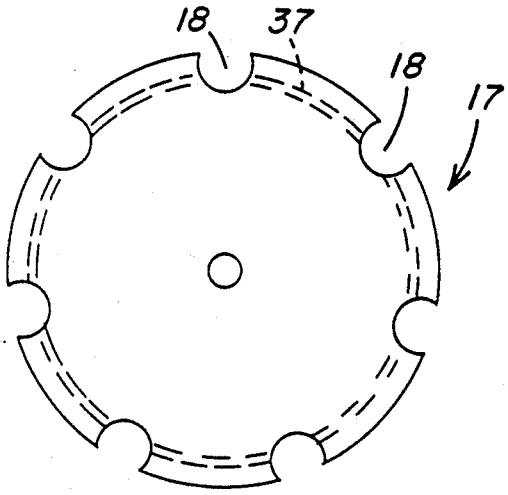
FIG. 6
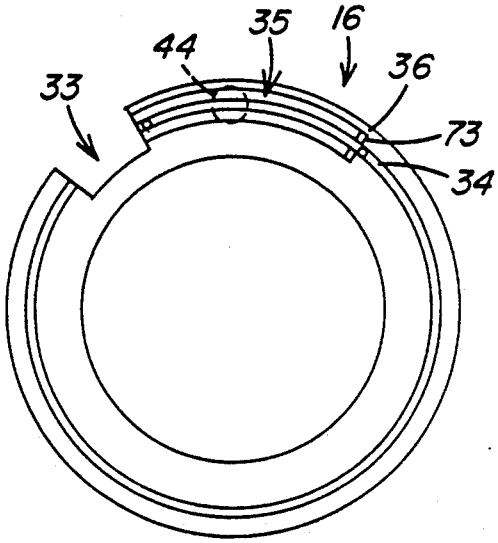
FIG. 7
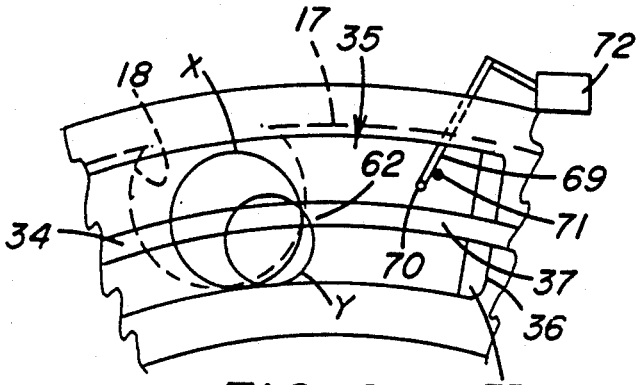
FIG. 8

COIN RECEIVING AND VALIDATION APPARATUS

FIELD OF THE INVENTION

This invention relates to a coin receiving an validation apparatus which in one particular aspect is applicable to the collection and validating coins in toll systems for roads or the like.

DESCRIPTION OF THE PRIOR ART

It is becoming increasingly popular in communities to provide toll roads where users of a road system pay a certain toll for travelling on such a road system. In most cases, a toll collection station is provided at one or more positions on the road system and the motorist is required either to manually pay the toll to operators at the toll station or deposit toll monies into a collection chute so that a boom gate will open to permit passage of the vehicle onto a certain section of the road system. In such arrangements, it is obviously important that toll stations operate efficiently so that minimum disruption to traffic is provided.

The current automatic toll systems which are in use have a number of disadvantages. For example, for validation of coins deposited into the collection chute, the deposited coins are moved onto a ramp where they roll pass a validation coil and if the coin is accepted, a gate solenoid is operated to let the coin pass. The coin then moves past a second coil (gone coil) which activates coin identification pulses and it is only after this is achieved that coin validation is complete. In the above arrangement, coins can become stuck and block the coin machine. Furthermore, as the rate of roll time of each coin varies depending upon its rim diameter or configuration and weight, large time variations can occur in the rolling movement of the coins past the respective sensing coils.

SUMMARY OF THE INVENTION

The present invention aims to overcome or alleviate one or more of the above disadvantages by providing a coin receiving apparatus which permits increased speed, accuracy and uniformity of operation both in sensing defect or foreign coins and in sensing the correct or incorrect amount deposited into the mechanism. The coin apparatus of the invention whilst particularly suited to use in toll systems, may be employed in many other situations where coin detection and/or validation is required. Other objects and advantages of the invention will become apparent from the following description.

With the above and other objects in view, the present invention provides in a preferred aspect coin receiving apparatus including a coin acceptor mechanism comprising a coin receiving body, said body being provided with at least one recess adapted to receive a coin therein, sensing means for sensing whether a said coin comprises a valid coin, means for moving said body relative to said sensing means whereby to cause a said coin to be moved passed said sensing means and means for rejecting an invalid said coin as sensed by said sensing means.

Preferably said coin receiving body comprises a generally planar body and said at least one recess comprises a recess opening to the periphery of said body. Most suitably, said body comprises a disc-shaped body and there are provided means for causing rotation of said disc-shaped body and thereby movement of a said coin in a said recess past said sensing means.

Preferably, said coin receiving body is supported for movement relative to a base, said base including a rebate adapted to receive a said coin from said recess in said coin receiving body, said body being adapted to convey said coin along said rebate and past said sensing means. Suitably, said coin receiving body includes an abutment member on the trailing side of said recess and adapted to engage a said coin to cause movement thereof along said recess. Preferably the leading end of said abutment member is shaped so as to engage the periphery of a coin above the centre thereof. Suitably, said base includes a groove for receiving said abutment member for passage therealong. Preferably, said base includes a discharge opening for receiving valid coins and directing valid coins for collection.

Preferably, said base includes a wall member movable between a first operative position adjacent said coin receiving body for guiding coins into said recess and a second position wherein said wall member is moved away from said coin receiving body to permit dumping from said coin acceptor mechanism. Hopper means are preferably associated with said wall member for receiving and guiding coins towards said recesses, said hopper means being adjustably mounted relative to said wall member.

The apparatus also suitably includes an escrow assembly for receiving coins from said coin acceptor mechanism, said escrow assembly including a housing having a movable barrier therein, said barrier defining in said housing at least one compartment for receiving said coins, said housing having an outlet through which coins may pass upon rotation of said barrier. Preferably said barrier includes a first ramped portion upon which coins may locate and a second abutment portion for moving coins into said outlet.

Suitably, the coin detection means comprises coin contact electromagnetic sensing means which may be in the form of one or more sensing coils located in or adjacent said base.

BRIEF DESCRIPTION OF THE DRAWINGS

In order that the invention may be more readily understood and put into practical effect, reference will now be made to the accompanying drawings which illustrate a preferred embodiment of the invention and wherein:

FIG. 4 is a side view of the coin acceptor mechanism of the apparatus;

FIG. 4A illustrates in sectional view the connecting link for the coin or rubbish dump;

FIG. 5 is an enlarged sectional view of the coin acceptor mechanism of the apparatus in the region A of FIG. 4;

FIG. 6 is a plan view of the coin pick-up wheel;

FIG. 7 is a plan view of the base insert of the coin acceptor mechanism;

FIG. 8 illustrates the manner in which coins are conveyed by the coin pick-up wheel past the coin sampling device;

DETAILED DESCRIPTION OF THE INVENTION

Figure 1:
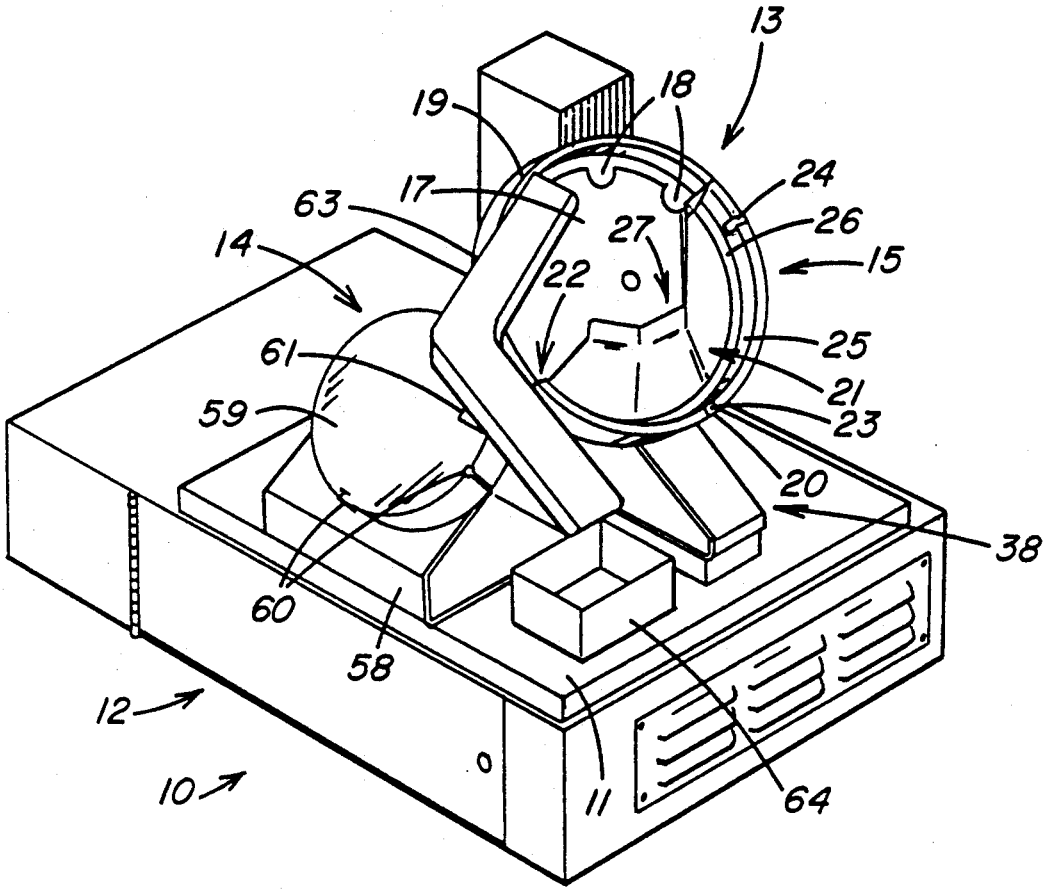
FIG. 1 is a perspective view of the coin receiving apparatus according to the invention.
Figure 3:
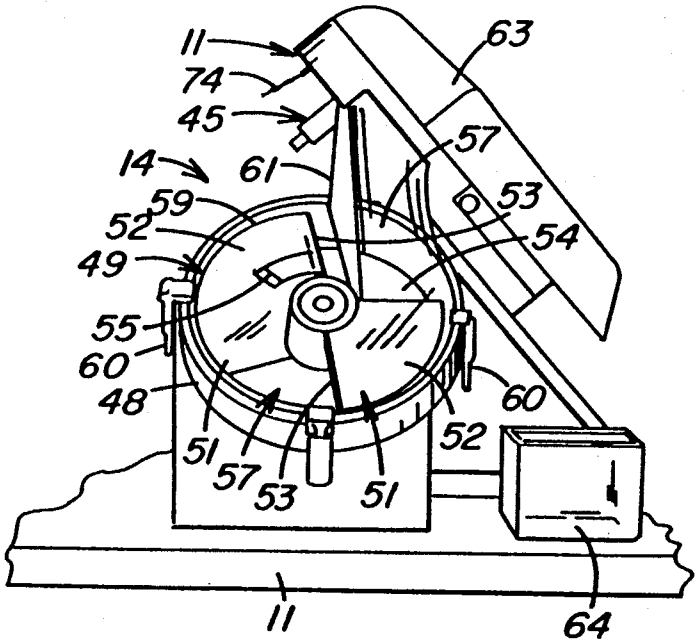
FIG. 3 is a partial side view of the apparatus.
Figure 2:
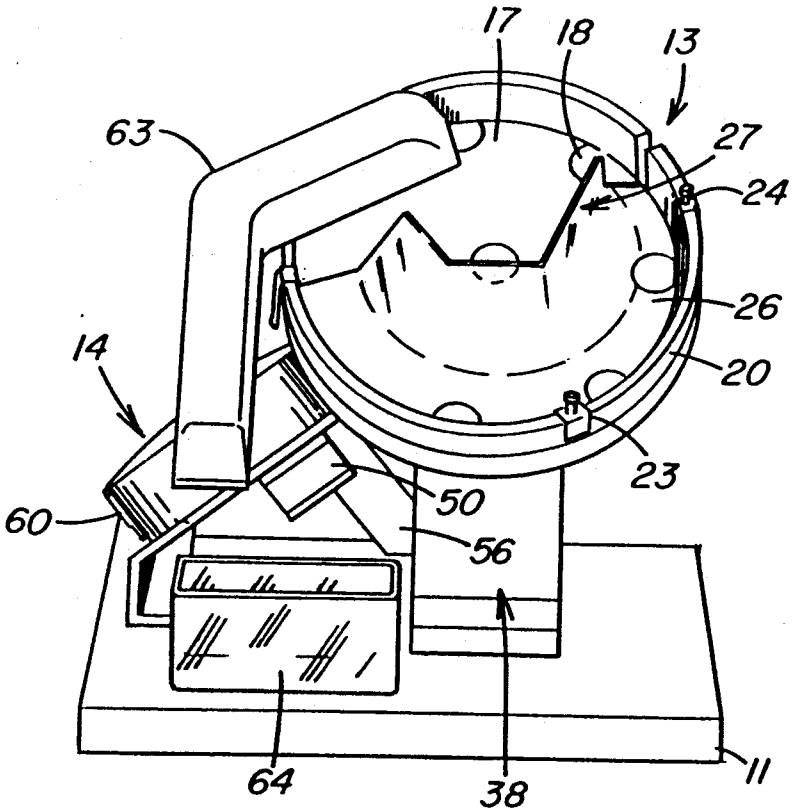
FIG. 2 is a partial front view of the apparatus of FIG. 1.
Figure 9:
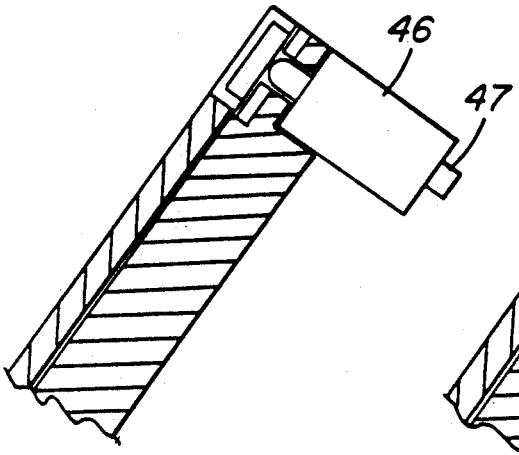
FIGS. 9 and 10 illustrate in respective positions one form of coin ejector mechanism according to the invention.

Referring to the drawings and firstly to FIG. 1 there is illustrated an automatic coin receiving apparatus 10 according to the present invention having a planar base 11 mounted on a vault chamber 12 which may incorporate vaults for the collection of coins deposited into the apparatus 10. Mounted on the base 11 is a coin acceptor mechanism 13 which is adapted to receive coins and either deposit same into an escrow assembly 14 and/or reject coins.

The coin acceptor mechanism 13 also illustrated in FIGS. 2 to 8 includes an outer circular base 15 upon which is mounted a base insert 16 and a coin pick-up wheel 17, the latter being of disc-like form and including a plurality of coin accepting recesses or slots 18 in its periphery for receiving and conveying coins. The base 15 includes a fixed part-annular rim 19 and a movable part-annular wall member 20 which is pivotally mounted at opposite sides to the remainder of the base 15 and which supports a hopper 21 which is preferably constructed of a transparent material and which is arranged to receive coins and guide coins downwardly to the lower portion of the coin acceptor mechanism 13. The hopper 21 is pivotally mounted at 22 to one side of the wall member 20 by means of an aperture in the hopper locating over a pin fixed to the wall member 20 and a pair of adjustment screw devices 23 and 24 are provided on the hopper 21 for engagement with the member 20 at different circumferential positions to permit the hopper 21 to be positioned at a required spacing from the coin pick-up wheel 17 for a purpose which will hereinafter become apparent. The hopper 21 includes a part annular flange 25 which lies within and adjacent to the wall member 20 and a base wall 26 which lies in a plane substantially parallel to the wheel 17, the hopper 21 extending outwardly from the wall 26 to define a coin guiding chute 27.

The member 20 is arranged to be pivotable away from the remainder of the base 15 under the control of a motor driven crank 28 which is connected to the wall 20 via a link 29 which comprises two parts 30 and 31 telescopically engaged and biased towards each other via a spring 32 (see FIG. 4A). In the normal position of the member 20 the crank 28 is moved to a position such that the spring force exerted by the spring 32 biases the annular wall 20 to the position of FIG. 4, however, rotation of the crank 28 will cause the wall 20 to move to the position shown in dotted outline. The crank 28 is connected to any suitable driving source such as a motor 28' which may be actuated manually or automatically as described below.

The base insert 16 of the coin acceptor mechanism 13 as shown more clearly in FIG. 7 is of annular form and includes a cut-out discharge slot 33 in its outer periphery adapted for alignment with a similar slot in its base 15 and an annular groove 34 terminating at opposite ends at the discharge slot 33. The base insert 16 further includes an elongated coin receiving rebate 35 which is adapted to receive coins at the position 36 from the pick-up wheel 17. The rebate 35 terminates in the slot 33 so that coins in the rebate 35 may be deposited therethrough.

The coin pick-up wheel 17 includes on its underside a plurality of arcuate ribs 37 which extend rearwardly from the trailing sides of the coin recesses 18 and which locate in use within the annular groove 34 of the base insert 16 for movement therearound upon rotation of the wheel 17.

The coin acceptor mechanism 13 is supported at an inclination by a support member 38 so that coins deposited into the hopper 21 fall under the influence of gravity to the lower portion of the acceptor mechanism 13 and are held in an inclined plane as they are conveyed by the pick-up wheel 17. The wheel 17 is arranged to be driven by a toothed belt 39 (see FIG. 4) connected between a pulley 40 on the shaft of a DC drive motor 41 and a pulley 42 on the end of a shaft 43 connected to the wheel 17 for rotational movement therewith. Preferably, the pulley 40 and/or drive motor 41 includes a clutch.

The base insert 16 also incorporates a coin detection device mounted in the region 44 for detection of coins as they are moved therepast. The detection device may comprise an non-contact electromagnetic sampling unit associated with a microprocessor which classifies the coins in accordance with their diameter, thickness, resistivity and/or composition. Alternatively, other forms of coin detection devices may be employed such as photo-electric or mechanical devices for detecting coin diameter. The base insert 16 also incorporates a coin rejection mechanism 45 which preferable comprises a solenoid 46, the plunger 47 of which is normally located at or adjacent the surface of the base insert 16 but which when actuated extends outwardly of the base insert 16 to reject coins or other foreign objects as described below.

The escrow assembly 14 includes a cylindrical housing 48 provided with a rotatable paddle 49 which is adapted to be driven in a stepwise manner via a further DC motor 50. The paddle 49 comprises two or more radially extending arms 51, each of which includes a ramped portion 52 terminating in a radially extending abutment wall 53. The base 54 of the housing 48 is provided with an outlet aperture 55 (shown in dotted outline) towards the upper end of the housing for deposit of coins via a guide 56 into the vault chamber 12 and the arms 51 separate the housing into respective compartments 57.

The escrow assembly 14 is also supported in an inclined attitude on a support frame 58 and a cover 59 preferably formed of transparent material is releasable engaged with the housing 48 by means of clips 60 and incorporates an entry chute 61 which is adapted to communicate with the discharge slot 33 in the base insert 16 and guide coins onto the ramped portions 52 of the arms 51.

In use the pick-up wheel 17 is constantly driven by its motor 41 and the hopper 21 communicated with any suitable intake chute, say on a toll road system. When coins are received by the hopper 21 they fall to the lower portion of the acceptor mechanism 13 being guided between the converging hopper and wheel 17 so as adopt a position parallel to the plane of the wheel and to locate in respective recesses 18. The position of the hopper 21 is adjusted by means of the screw devices 23 and 24 so that at the lower portion of the acceptor mechanism 13 the distance between the base wall 26 of the hopper 21 and the pick-up wheel 17 is normally such as to only allow one coin to be located therebetween. If a pair of coins become arranged one on top of the other the base wall 26 of the hopper 21 will be engaged by the upper coin and lift against gravity away from the wheel and the frictional force exerted on the upper coin by the hopper wall 26 will cause it to be moved relatively into another recess 18 of the pick-up wheel 17. At the adjustment screw device 24 the spacing is increased such that a pair of coins will not be held in a single recess by the hopper wall 26 so that one coin located on top of another will fall from the lower coin under the influence of gravity to the lower portion of the acceptor mechanism to locate in a further recess 18. Coins in the recesses 18 are conveyed by rotation of the wheel 17 towards the upper end of the acceptor mechanism 13 until they reach the portion 36 of the rebate 35 in the base insert 16 and will thence fall under the influence of gravity into the rebate 35. The coins will then be conveyed along the rebate 35 by the leading end of a rib 37 in the manner shown in FIG. 8. The leading end 62 of each rib 37 is cut back to be tapered to suit all coins so that irrespective of the size of the coins, a portion of the leading end 62 of the ribs 37 will always engage the coins indicated as X and Y at a position above their centre. This will ensure that the coins are stably held as they roll or are pushed along the rebate 35 for coin validation and detection at the position 44.

Figure 10:
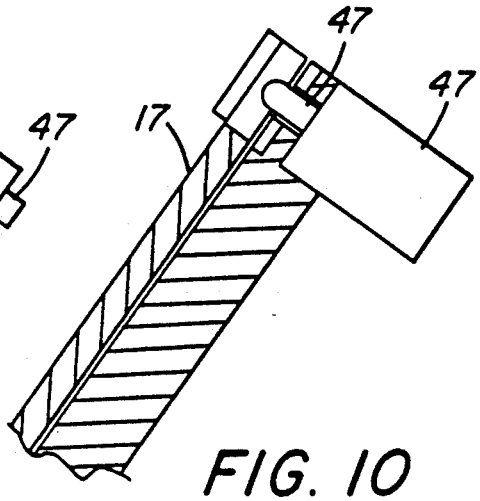

If valid coins are detected by the coin validator in the position 44 they are deposited via the entry chute 61 into the escrow assembly 14 so that they position on the ramped portion 52 of the arms 51. Each coin deposited can thus be readily viewed through the transparent cover 59. When the correct number of coins, as detected by the validator have been received the motor 50 is actuated so as to cause stepwise rotation of the paddle 49. As the paddle 49 rotates the coins will fall from the ramped portion 52 into one of the compartments 57 to be swept by the trailing wall 53 into the outlet aperture 55 and thence into the collection chamber 12. If an invalid coin is detected by the validator, the solenoid 46 will be triggered to cause rapid advancement of the plunger 47 in the manner shown in FIG. 10 so as to eject the invalid coin. The invalid coin may be directed by a further chute 63 into a dump tray 64 for return to the customer. Alternatively, the invalid coin may by directed via a chute (not shown) to a further compartment of the escrow assembly 14 so as to be viewable by the operator and customer.

In the event that coins become jammed in the coin acceptor mechanism 13 the hopper 21 will simply rise up against its gravitational bias until the jam has passed. Should any rubbish be deposited into the hopper 21 the crank 28 can be actuated to cause the annular wall 20 to pivot to the position shown in dotted outline in FIG. 4 so that that material is dumped from the acceptor mechanism 13.

Figure 11:
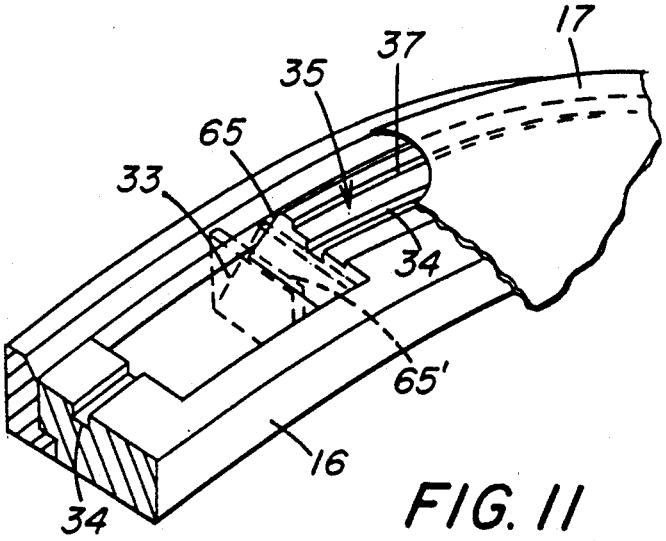
FIG. 11 is a view showing portion of the base insert adjacent the coin discharge opening with an alternative form of coin ejection system.

FIG. 11 illustrates further details of the acceptor mechanism 13 adjacent the coin discharge opening 33 with portion of the pickup wheel 17 disengaged from the base insert 16 and incorporating an alternative coin eject system. In this arrangement a gate 65 shown in dotted outline is located in the opening 33 and normally permits coins to pass from the rebate 35 into the discharge opening 33 for collection in the escrow assembly 14. If, however, an invalid coin is sensed, the gate 65 is moved to the position shown as 65' to intercept the invalid coins and direct them either into the dump tray 64 or into one of the compartments 58 of the escrow assembly 14. The gate 65 is actuated by any suitable motive means such as via a linkage connected to a solenoid or by an angular actuator and responds to the coin validator as previously.

Further control of the apparatus 11 of the invention is achieved by means of a timing wheel 66 (see FIG. 4) which is mounted to the shaft 43 so as to be rotatable with the pickup wheel 17. The timing wheel 66 may be of similar form to the pickup wheel and includes recesses 67 corresponding in number and spacing to the recesses 18. Alternatively, the wheel 66 may include a plurality of spaced apertures of corresponding number and spacing. An optoelectric sensor 68 associated with a timing circuit is mounted adjacent to the wheel 43 to sense the presence of the recesses 67 in the wheel 66 as it rotates and thus the timing of rotation of the pickup wheel 17. Should for some reason an obstruction be encountered causing the wheel 17 to slow down or stop, this will be sensed by the sensor 68 which will send a signal to its associated circuitry and control circuit for the wheel drive motor 41. The control circuit will thus react to stop the drive motor 41 and cause it to reverse so as to free the obstruction. The motor 41 is reversed to move through a certain preset angle and forward and reversing increments of movement may occur as preset in the control circuitry so as to provide the opportunity for the obstruction to clear. The control circuit will then reset to cause normal operation of the wheel 17. If an obstruction is still sensed by the sensor 68, the crank 28 will be actuated to lift the member 20 to cause dumping from the coin acceptor mechanism 13 whilst the motor 41 is cycling in its forward and reverse movements.

The apparatus 10 may further include a coin diameter or size sensing device which may be associated with the electromagnetic coin validator as described further below. Preferably, the size sensing device includes an arm 69 (see FIG. 8) pivotally mounted to the base 11 and extending into the rebate 35. The arm 69 includes a boss 70 at its inner end adapted to be contacted by the periphery of a coin so as to cause the arm 69 to pivot upwardly. A stop 71 prevents the arm 69 contacting the ribs 37. The extent of pivotal movement of the arm 69 corresponds to the diameter of the coin being contacted and movement sensing means 72 are provided to sense the amount of movement. Alternatively, angular movement sensing means may be provided for this purpose. The signal provided by the movement sensing means may be used in combination with the signal provided by the coin detection coil/s to provide an accurate determination of the coins received. Thus although the movement sensing means 72 may provide a signal which corresponds to a coin of a certain diameter, that signal may also be representative of a counterfeit device. The detection provided by the detection coils however will determine whether in fact the apparent coin sensed by the movement sensing means is a true coin. If not, the coin will be ejected.

The rebate or groove 35 is preferably provided adjacent the position 36 with a ramp 73 which leads into the rebate 35. Thus if a coin becomes jammed in the rebate 35 causing the pickup wheel 17 to stop, reversal of the motor 41 as described above will permit the jammed coin to be moved with the aid of the ramp 73 out of the rebate 35.

The use of the rebate 35 in the base insert 16 is primarily for the stabilisation of small coins as they are moved past the coin validator to ensure accurate detection. In some situations however, the rebate 35 may be eliminated so that the coins are simply conveyed past the coin validator whilst remaining in the recesses 18. Of course in this arrangement, the ribs 37 on the pickup wheel 17 as well as the groove 34 may be eliminated.

Preferably the coin pick-up wheel 17 and base insert 16 are formed of a hard wearing material, such as a polymer material. Preferably also a hard wearing lining is used on the inside of the annular member 20 and annular wall 19 of the base 11.

Preferably speed and position sensing means are associated with the escrow paddle 51 to control its operation and timing. Such means may comprise one or more circumferentially spaced magnets in the rim of the paddle 51 whose presence is sensed by a Hall effect transistor mounted adjacent the disc rim. The signal generated in the transistor is used as a timing signal to control the motor 50 to ensure that the paddle 51 is indexed to the correct position for receipt of coins from the chute 61 or for deposit of coins into the aperture 55 when coin validity is sensed.

Clutch assemblies are preferably associated with each drive motor for the pickup wheel 17 and escrow paddle 51 so that damage in the event of jamming caused say by deformed coins does not occur. The pickup wheel 17 may incorporate any number of coin recesses 18 and the valid or invalid coins may be directed to any position as desired.

The coin sensing means suitably comprises one or more sensing coils embedded in the base insert 16 with connecting wires 74 extending therefrom (see FIGS. 3 and 4) for connection to control apparatus. As stated above however alternative coin sensing means may be employed.

Whilst the above has been given by way of illustrative embodiment of the invention, all such modifications and variations thereto as would be apparent to persons skilled in the art are deemed to fall within the broad scope and ambit of the invention as herein defined in the appended claims.

We claim:

1. Coin receiving apparatus including:

a coin acceptor mechanism comprising a generally planar disc-shaped coin receiving body, said body being provided with at least one recess adapted to receive a coin therein, said recess opening to the periphery of said generally planar coin receiving body;

sensing means for sensing the validity of said coin;

means for rotating said disc-shaped body relative to said sensing means whereby to cause said coin to be moved past said sensing means;

a base for said coin receiving body, means for supporting said coin receiving body during rotation of said coin receiving body relative to said base, said base including a rebate adapted to receive said coin from said recess in said coin receiving body, said body being adapted to convey said coin along said rebate and past said sensing means;

said base including a wall member movable between a first operative position adjacent said coin receiving body for guiding coins into said recess and a second position wherein said wall member is moved away from said coin receiving body to permit dumping from said coin acceptor mechanism;

hopper means associated with said wall member for receiving and guiding coins towards said recess, said hopper means being adjustably mounted on said wall member, and means for ejecting an invalid coin as sensed by said sensing means.

2. Coin receiving apparatus according to claim 1, wherein said coin receiving body includes an abutment member on the trailing side of each recess and adapted to engage a said coin to cause movement thereof along said rebate.

3. Coin receiving apparatus according to claim 2, wherein the leading end of said abutment member is shaped so as to engage the periphery of a coin above the centre thereof.

4. Coin receiving apparatus according claim 2, wherein said base includes a groove for receiving said abutment member for passage therealong.

5. Coin receiving apparatus according to claim 4, wherein said base includes a discharge opening through which coins may pass for collection.

6. Coin receiving apparatus according to claim 1, wherein said validity sensing means includes size sensing means.

7. Coin receiving apparatus according to claim 1, and including an escrow assembly for receiving coins from said coin acceptor mechanism, said escrow assembly including a housing having a movable barrier therein, said barrier defining in said housing at least one compartment for receiving said coins, said housing having an outlet through which coins may pass upon rotation of said barrier.

8. Coin receiving apparatus according to claim 7, wherein said barrier includes a first ramped portion upon which coins may locate and an abutment portion for moving coins into said outlet.

9. Coin receiving apparatus according to claim 7, wherein said housing includes transparent cover means through which coins in said escrow assembly may be viewed and chute means associated with said cover means for guiding coins from said coin acceptor mechanism into said housing.

* * * * *